US005277099A

United States Patent [19]

Powers

[11] Patent Number: 5,277,099

[45] Date of Patent: Jan. 11, 1994

[54] REDUCED ICING LOW FRICTION AIR VALVE

[75] Inventor: Frederick A. Powers, Maple Grove, Minn.

[73] Assignee: Graco Inc., Minneapolis, Minn.

[21] Appl. No.: 904,447

[22] Filed: Jun. 25, 1992

[51] Int. Cl.[5] ..... F01L 31/00; F16K 31/44

[52] U.S. Cl. ..... 91/350; 91/465; 60/370; 137/338; 137/625.25; 251/297

[58] Field of Search ..... 91/350, 218, 265, 271, 91/272, 273, 465, 466; 60/370; 137/338, 625.25; 251/297

[56] References Cited

U.S. PATENT DOCUMENTS

| | | | |
|---|---|---|---|
| 2,847,182 | 8/1958 | Mancusi, Jr. | 251/297 |
| 3,101,094 | 8/1963 | McKenzie | 137/340 |
| 3,400,537 | 9/1968 | Mercier | 91/466 |
| 3,473,324 | 10/1969 | Mercier | 91/466 |
| 3,548,862 | 12/1970 | Nakamura | 137/340 |
| 3,916,941 | 11/1975 | Usry | 137/340 |
| 4,079,660 | 3/1978 | Ives | 251/297 X |
| 4,169,488 | 10/1979 | Goloff et al. | 137/340 |
| 4,261,385 | 4/1981 | Worley | 137/340 |
| 4,392,509 | 7/1983 | Siddall | 137/340 |
| 4,921,408 | 5/1990 | Kvinge et al. | 417/368 |
| 5,027,916 | 7/1991 | Rohringer | 91/625.25 |

FOREIGN PATENT DOCUMENTS

| | | | |
|---|---|---|---|
| 61964 | 8/1938 | Denmark | 91/218 |
| 510717 | 10/1930 | Fed. Rep. of Germany | 137/338 |
| 1024526 | 2/1958 | Fed. Rep. of Germany | 91/218 |
| 742007 | 12/1932 | France | 91/218 |
| 591634 | 4/1959 | Italy | 91/350 |

*Primary Examiner*—Edward K. Look
*Assistant Examiner*—Hoang Nguyen
*Attorney, Agent, or Firm*—Douglas B. Farrow

[57] ABSTRACT

An external air valve for a reciprocating air motor is provided with a the ability to transfer heat from incoming compressed air into the valve cups to prevent icing and a low friction mechanism for the valve slide to enhance reliability. The design has a housing which forms an air chamber, and located in the air chamber is a slide member containing two cups which alternately cover ports leading to the upper and lower chambers of the air motor piston. The slide has slotted rollers to reduce pneumatic loading and decrease friction during sliding. The shift rod is provided with a central valve spring located in an aperture in the slide, along with spring retaining plates to provide and assist in shifting the valve in conjuction with a detent to assure that the valve is positioned in one of two operating positions. The pressurized chamber, in conjunction with fins, apertures and other heat transfer apparatus in the slide assures that heat is applied to the cups of the slide in order to prevent icing.

11 Claims, 5 Drawing Sheets

REDUCED ICING LOW FRICTION AIR VALVE

BACKGROUND OF THE INVENTION

Reciprocating air motors of the type which are used to drive reciprocating fluid pumps have been in use for many years. One of the drawbacks to such air motors is their tendency to ice up when operated continuously due to the repeated condensation of moisture and associated cooling which takes place during operation, particularly in the air valve mechanism.

U.S. Pat. No. 4,921,408 (commonly assigned with the instant invention and hereby incorporated by reference) deals with one aspect of decreasing icing during operation, and the instant invention deals with another aspect.

SUMMARY OF THE INVENTION

It is therefore an object of this invention to provide an air valve for reciprocating air motor which greatly reduces icing during operation.

It is also an object of this invention to provide an air valve design which is extremely reliable and which provides for low friction operation and which does not hang up or otherwise stall during operation.

An open-topped housing (as used herein, the term "top" actually refers to the side of the air valve which faces the air motor) has a generally rectangular slide located therein. The slide has two valve cups which face upwardly and rectangular seals around each of the cups. Most importantly, the slide includes a number of fins and apertures to allow transfer of heat from the incoming air to the slide and particularly the valve cups.

Because reliability is important, located in the top of the slide are four elongated slots which each contain a cylindrical roller. The aforementioned rollers and seals contact port plates which are fastened over the top of the housing which is in turn fastened to the side of the air motor. Use of the rollers greatly reduces the pneumatic loading of the slide and seals against the port plates and greatly reduces the friction inherent in the device thus enhancing reliability.

A pair of spring-loaded detents and detent ramps are provided to position the slide in one or the other of two positions. A shift rod runs through the middle of the chamber and has located at the center thereof a shift spring along with spring retainers at either end of the spring. The spring/retainer assembly is located in a central aperture of the slide and causes the slide to shift back and forth from one position to the other. A pair of rocker arms to move back and forth, the rocker arms being actuated by push rods which are in turn engaged by the piston and the air motor.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
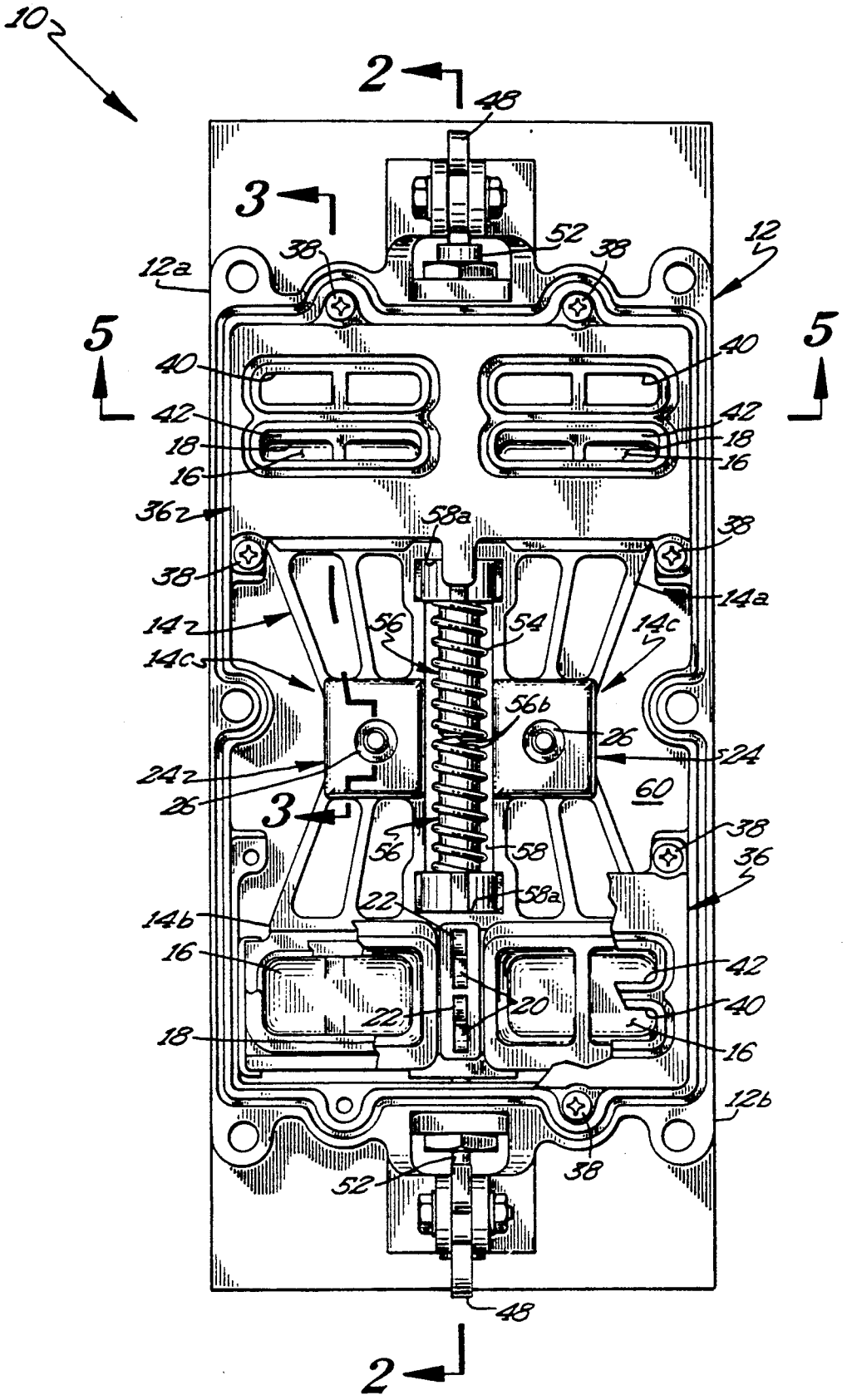
FIG. 1 is a top view of the instant invention, partially cut away to show various components.
Figure 2:
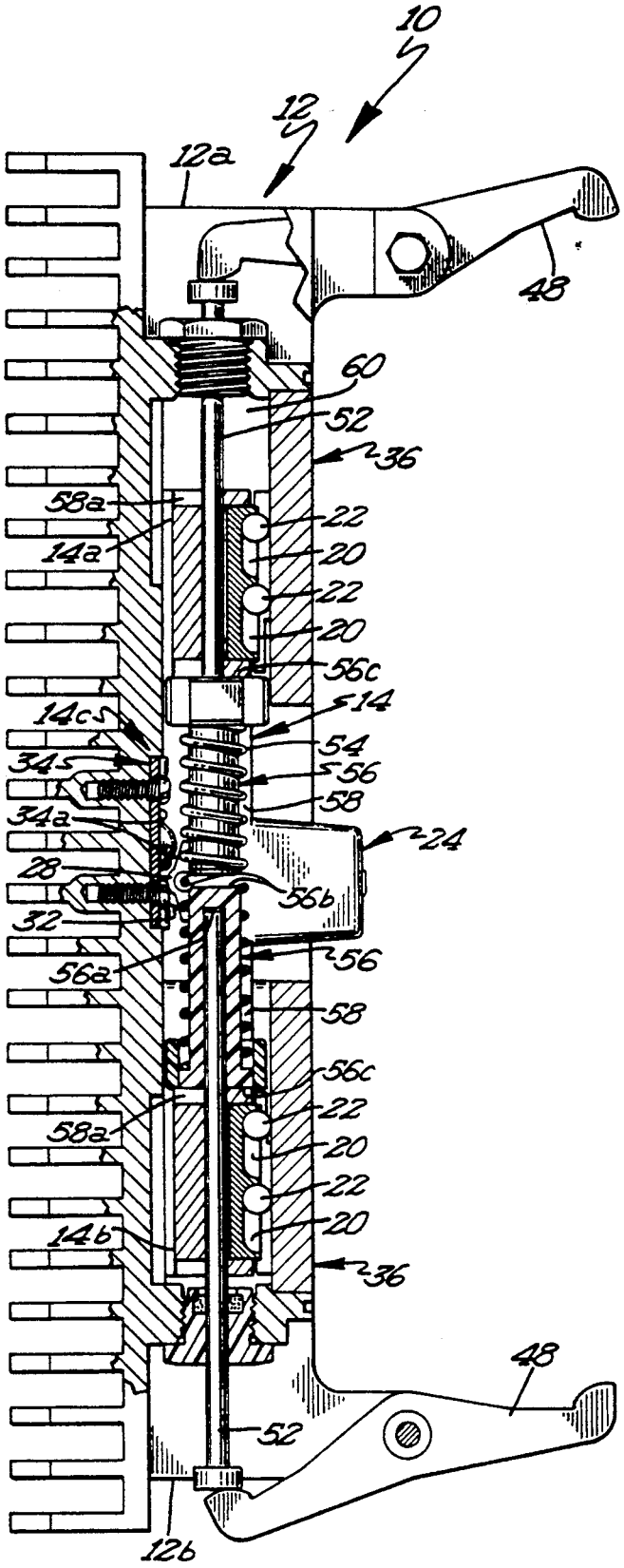
FIG. 2 is a sectional view taken along line 2—2 of FIG. 1.
Figure 6:
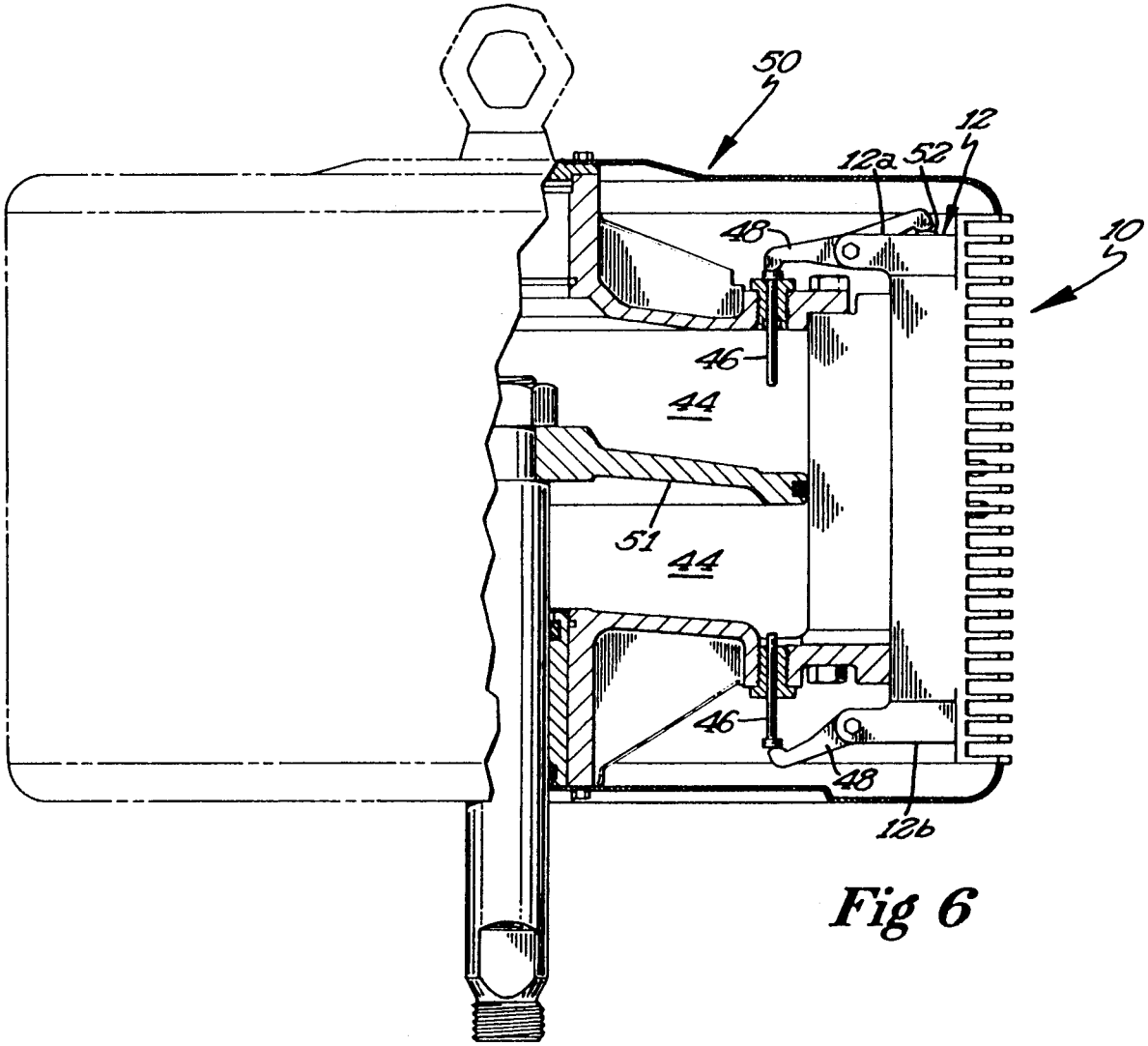
FIG. 6 is a partially-cut-away view showing the air valve of the instant invention as integrated with the reciprocating air motor.

The air valve of the instant invention, generally designated 10, is shown broadly in FIG. 1, and as applied to an air motor 50 in FIG. 6. Housing 12 has first and second ends **12*a* and 12*b*, respectively, and contains a slide member 14 having first and second ends 14*a* and 14*b*, respectively. Slide 14 also includes heat absorbing means which are comprised of fins 14*d* and apertures 14*e***.

The top surface (shown in FIG. 1) of slide 14 is provided with two or more valve cups 16 which face upwardly and which have a peripheral plastic seal 18 located thereabout. Also provided are a plurality of elongated slots 20 each of which contains a thin cylindrical roller 22 having a diameter less than the length of the slot to allow it to roll back and forth.

Figure 3:
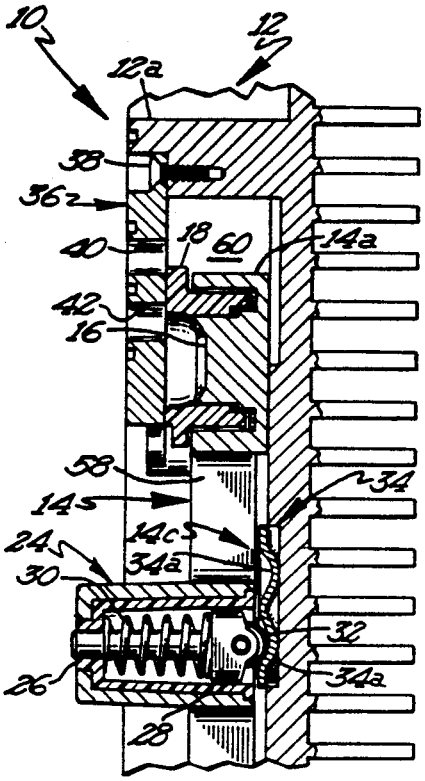
FIG. 3 is a sectional view taken along line 3—3 of FIG. 1.
Figure 4:
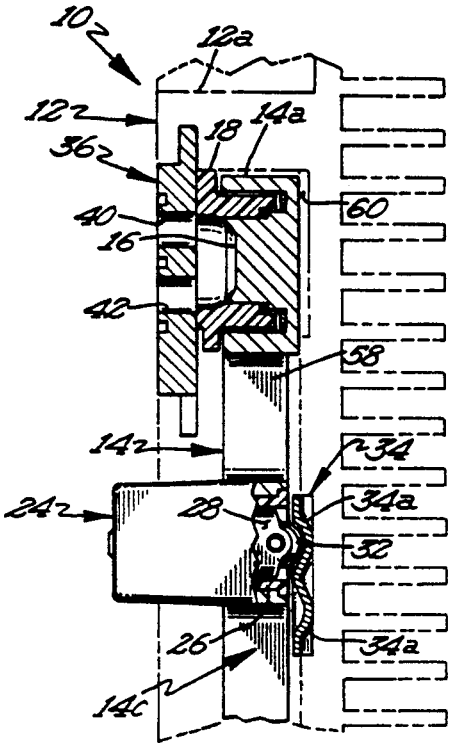
FIG. 4 is a sectional view taken along a section similar to that of FIG. 3 but showing the slide in the alternate position from that of FIG. 3.
Figure 5:
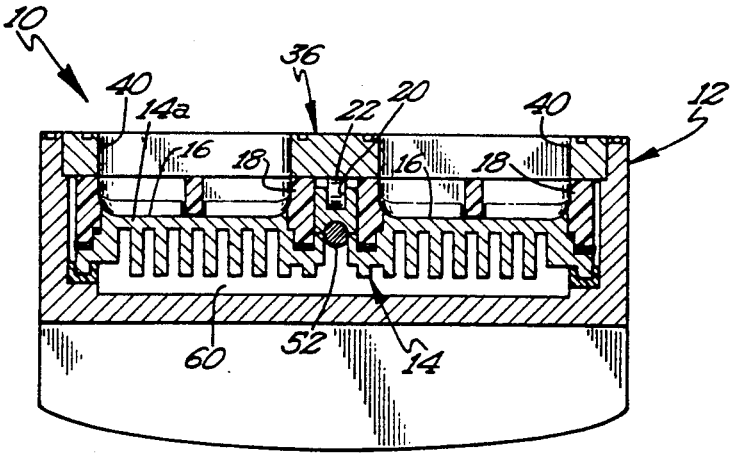
FIG. 5 is a sectional view taken along line 5—5 of FIG. 1.

Detent assemblies 24 are located in the center of slide 14 and are comprised of a detent area **14*c* which is part of slide 14 which may be cast, machined or otherwise formed in a single piece. Detent assembly 24 is further comprised of a plastic insert member 26, detent member 28, and a detent tensioning spring 30. Detent roller 32 is attached to detent member 28 and in turn rides in detent track 34 which has two depressions 34*a* which correspond to the two positions as shown in FIGS. 3 and 4**.

Port plates 36 are secured via screws 38 to housing 12. Each said port plate has two ports, a piston chamber port 40 and an exhaust port 42. When valve 10 is attached to air motor 50, piston chamber ports 40 are connected respectively to the upper and lower chambers 44 (shown in FIG. 6) while ports 42 are connected to the exhaust mechanism which is described in more detail in the aforementioned U.S. Pat. No. 4,921,408.

Push rods 46 are alternately operated by air motor piston 51 and in turn operate rocker arms 48. Rocker arms 48 in turn move shift rod 52 back and forth. In the FIG. 6 embodiment, shift rod 52 is actually formed of two halves assembled as follows. Each half of the shift rod 52 is inserted into a recess **56*a* in spring retainer 56. The inboard ends 56*b* of retainers 56 are normally spaced from one another except during changeover. Distal ends 56*c* of retainers 56 are confined by the ends 58*a* of aperture 56 in slide 14**.

Figure 7:
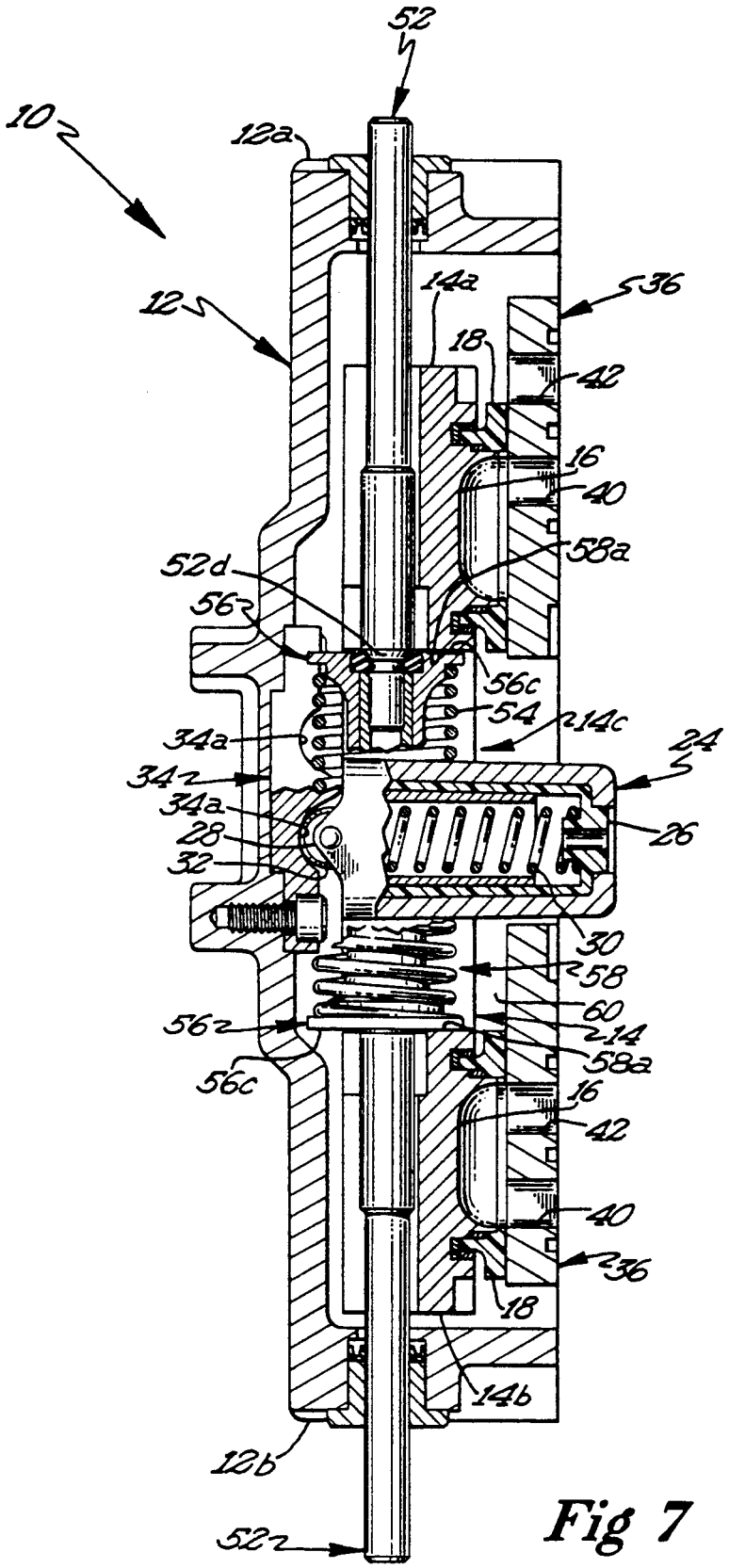
FIG. 7 shows a detail of the shift rod and spring retainer of the preferred embodiment from a view similar to that of FIG. 2.

In the preferred embodiment shown in FIG. 7, shift rod 52 is made assembled from at least two pieces and has a pair of shoulders **52*d* which engage retainers 56, and which in turn sandwich spring 54 therebetween. Again, the inboard ends of retainers 56** are normally spaced from one another except during changeover.

In operation, then, a source of pressurized air is attached to the interior chamber 60 in housing 12 thereby filling chamber 60 with compressed air. When the mechanism is in the position shown in FIGS. 1 and 3, port 40 which leads to chamber 44 is directly connected to and communicates with interior chamber 60 which is filled with pressurized air such that the connected chamber 44 is thus pressurized.

In that position, exhaust port 42 communicates with cup 16, the other part of which is blocked by the solid surface portion of port plate 36. As piston 51 nears the end of its travel, it contacts push rod 46 which in turn actuates rocker arm 48 and causes shirt rod 52 to begin to shift from one position to the other.

In the FIG. 7 embodiment, shoulder 52*d* on shift rod 52 presses on retainer 56 thereby compressing spring 54 and storing energy therein. As the retainer ends 56*b* contact, the force from the shift rod is passed through the first retainer 56, the spring 54 and thence the other retainer whereupon slide 14 starts to move. When the detent assemblies 24 have moved far enough, the energy compressed in spring 54 will snap the slide across the detent and into the other position as shown in FIG. 4 whereby cup 16 causes ports 40 and 42 to communicate, thereby allowing air from that chamber to exhaust through exhaust port 42.

As can be appreciated, the two piston chambers 44 are always undergoing diametrically opposite processes, that is, while upper chamber 44 is being pressurized, lower chamber 44 is being exhausted and vice versa. While FIGS. 3 and 4 only show one end of slide 14 and cup 16, it can be appreciated that the same general process is utilized at the other end thereof.

It is contemplated that various changes and modifications may be made to the non-icing low-friction air valve without departing from the spirit and scope of the invention as defined by the following claims.

What is claimed is:

1. An air valve in combination with an air motor having a reciprocating piston and first and second piston chambers, said air valve comprising:

a housing having first and second ends and forming a valve chamber therein, said chamber being connected to an incoming source of pressurized air;

a slide having first and second ends and being slideably located in said chamber for reciprocation, said slide comprising means to absorb heat from said incoming pressurized air; first and second exhaust ports;

first and second valve cups located in said slide, said cups alternately directing said incoming pressurized air first from said valve chamber into each said piston chamber and thence from each said piston chamber into said exhaust ports as said slide reciprocates, said heat absorbing means transferring heat from said incoming pressurized air in said valve chamber into said valve cups thereby preventing icing and degradation of performance.

2. The air valve of claim 1 further comprising detent means for positioning said slide in one of first and second positions in said valve chamber.

3. The air valve of claim 1 further comprising a shift rod running through said valve chamber from said first valve chamber end to said second valve chamber end.

4. The air valve of claim 3 further comprising an aperture in said slide; and a spring located around said shirt rod and in said aperture.

5. The air valve of claim 4 further comprising means for retaining said spring on said shift rod and allowing compression of said spring but preventing expansion of said spring beyond a predetermined length.

6. The air valve of claim 5 wherein said retaining means comprises:

a length of decreased diameter at about the center of said shift rod and terminating at either end in shoulders; and first and second retainers resting against said shoulders and sandwiching said spring.

7. The air valve of claim 1 wherein said heat absorbing means comprises a plurality of fins and apertures.

8. The air valve of claim 1 wherein said slide has a top and a bottom and said top faces upwardly.

9. The air valve of claim 8 further comprising at least one port plates secured over said slide top and means for sealing each said cup to said port plate.

10. The air valve of claim 1 further comprising roller means between said slide and said port plate to reduce the pneumatic load and friction between said slide and said port plate.

11. The air valve of claim 10 wherein said roller means comprises a plurality of elongated slots in said slide top, each said slot containing a cylindrical roller.

* * * * *